US007029007B2

(12) United States Patent
Matsukawa

(10) Patent No.: US 7,029,007 B2
(45) **Date of Patent: *Apr. 18, 2006**

(54) ROTATABLE SHEET TRAY

(75) Inventor: Chiharu Matsukawa, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/008,688

(22) Filed: Nov. 8, 2001

(65) Prior Publication Data

US 2002/0060403 A1 May 23, 2002

(30) Foreign Application Priority Data

Nov. 21, 2000 (JP) ..... 2000-008291 U

(51) Int. Cl.
*B65H 1/04* (2006.01)

(52) U.S. Cl. ..... 271/171; 271/145; 271/163

(58) Field of Classification Search ..... 271/171, 271/145, 161, 162, 164; 399/107, 108, 110, 399/114, 377, 365, 372; 400/647, 647.1
See application file for complete search history.

(56) References Cited

U.S. PATENT DOCUMENTS

| | | | | |
|---|---|---|---|---|
| 5,975,520 | A * | 11/1999 | Shim | 271/171 |
| 6,056,286 | A * | 5/2000 | Koga | 271/145 |
| 6,070,868 | A * | 6/2000 | Nagato et al. | 271/145 |
| 6,588,742 | B1 * | 7/2003 | Matsukawa | 271/145 |

FOREIGN PATENT DOCUMENTS

| | | |
|---|---|---|
| JP | 6-71950 | 3/1994 |
| JP | 8-81092 | 3/1996 |
| JP | 10-101250 | 4/1998 |
| JP | 11-147320 | 6/1999 |
| JP | 11-199101 | 7/1999 |

OTHER PUBLICATIONS

Japanese Patent Abstract; Publication No. 11-147320, published on Jun. 2, 1999.
Japanese Patent Abstract; Publication No. 10-101250, published on Apr. 21, 1998.
Japanese Patent Abstract for JP8081092, published Mar. 26, 1996.
Japanese Patent Abstract for JP6071950, published Mar. 15, 1994.
Japanese Patent Abstract for JP11199101, published Jul. 27, 1999.

* cited by examiner

*Primary Examiner*—Patrick Mackey
(74) *Attorney, Agent, or Firm*—Osha Liang LLP

(57) ABSTRACT

A sheet feeder has a sheet tray 10 disposed in such a way as to be able to rotate around a shaft 12, which is provided in such a manner as to be nearly perpendicular to a sheet mounting surface 4*b*, and enabled to be accommodated in a sheet feeder body. The sheet feeder also has a step-like part 10*a* provided in the sheet tray 10 in such a fashion as to be placed in a connection portion, in which the sheet tray 10 and an upper edge part 4 of a sheet mounting portion 4 of the sheet feeder body are connected to each other, when the sheet tray 10 is used, and an abutting rib 13 for frontwardly pushing the sheet tray 10 when the sheet tray 10 is used.

10 Claims, 6 Drawing Sheets

ROTATABLE SHEET TRAY

BACKGROUND OF THE INVENTION

1. Field of the Invention

The present invention generally relates to a sheet feeder and to a sheet tray. More particularly, the present invention relates to a sheet feeder having a sheet tray body enabled to be accommodated in a sheet feeder body, and to a sheet tray having such a tray body.

2. Description of the Related Art

Hitherto, sheet feeders each having a sheet tray enabled to be accommodated in a sheet feeder body have been known as sheet feeders for use in printers, plotters, and electronic copying machines. Such sheet feeders each having a sheet tray enabled to be accommodated in a sheet feeder body are disclosed in, for example, JP-A-8-81092, JP-B-6-71950, and JP-A-11-199101. Hereinafter, an ink jet printer is described as an example of conventional equipment having such a sheet feeder.

FIG. 10 is a perspective view illustrating a conventional ink jet printer having drawer type sheet trays. FIG. 11 is a sectional side view, taken from the right of FIG. 10, illustrating a condition (that is, a used condition of the sheet tray), in which the sheet trays are drawn out of the conventional ink jet printer. FIG. 12 is a sectional side view illustrating an accommodated condition (that is, an unused condition of the sheet tray), in which the sheet trays are accommodated in the conventional ink jet printer.

First, an outline of the configuration of the ink jet printer having the conventional drawer type trays 105 and 106 is described hereinbelow by referring to FIGS. 10 to 12. The conventional ink jet printer has a bottom cover 101, a back cover 102 disposed on the rear surface thereof, and a front cover 103 disposed on the front surface thereof, as shown in FIGS. 11 and 12. A sheet mounting portion 104 is provided on the bottom cover 101. The bottom cover 101, the back cover 102, and the front cover 103 cover a motor (not shown) for driving a printer engine portion and other constituent elements of the printer. Further, as shown in FIG. 10, sheet guide portions 107*a* and 107*b* are provided on the sheet mounting portion 104. The sheet guide portion 107*a* is fixed to the sheet mounting portion 104. Moreover, the sheet guide portion 107*b* is attached to the sheet mounting portion 104 in such a manner as to be able to move in a transverse direction according to a sheet size.

Next, the details of the configuration of each of the conventional drawer type sheet trays 105 and 106 are described hereinbelow by referring to FIGS. 10 to 12. The conventional drawer type sheet tray 105 is mounted on the rear surface of the sheet mounting portion 104 in such a fashion as to be able to move in a direction parallel to a sheet feeding direction. Further, the sheet tray 106 is mounted on the back surface of the sheet tray 105. As shown in FIG. 12, when the sheet trays 105 and 106 are in an accommodated condition (that is, the non-use condition), these trays are accommodated in a space between the rear surface of the sheet mounting portion 104 and the back cover 102 of a sheet feeder body in such a way as to overlap with each other. When the sheet trays 105 and 106 are used, first, the sheet tray 106 is drawn out of the feeder body. As the tray 106 is drawn out therefrom, the tray 105 mounted on the surface of the tray 106 is drawn out therefrom to a position illustrated in FIG. 11.

As described above, the sheet tray 105 is mounted on the rear surface of the sheet mounting portion 104 in the conventional sheet feeder. Thus, an upper part of the sheet mounting portion 104 overlaps with a lower portion of a surface of the sheet tray 105. Therefore, a step-like part is formed in a connection portion in which the sheet tray 105 and the feeder-body-side sheet mounting portion 104 are connected to each other. This causes inconvenience that a sheet of paper is caught by the step-like part formed therebetween when the sheet of paper is transported along a sheet mounting surface of the sheet tray 105 and then put on the sheet mounting portion 104. Consequently, the conventional sheet feeder has encountered a problem in that this inconvenience adversely affects paper feeding.

SUMMARY OF THE INVENTION

The invention is accomplished to solve the aforementioned problem. Accordingly, an object of the invention is to provide a sheet feeder enabled to alleviate a difference in sheet-mounting-surface level between a sheet mounting surface of the sheet tray and that of the sheet mounting portion of a sheet feeder body in the connection portion, in which the sheet tray and the sheet mounting portion are connected to each other, and to provide a sheet tray having such a sheet tray body.

To achieve the foregoing object, according to an aspect of the invention, there is provided a sheet feeder (hereunder referred to as a first sheet feeder) that comprises a sheet tray body disposed in such a way as to be able to rotate around a shaft, which is provided in such a manner as to be nearly perpendicular to a sheet mounting surface thereof and enabled to be accommodated in a sheet feeder body, a step-like part provided in the sheet tray body in such a fashion as to be placed in a connection portion, in which the sheet tray body and an upper edge part of a sheet mounting portion of the sheet feeder body are connected to each other, when the sheet tray body is used, and a thrusting member for frontwardly pushing the sheet tray when the sheet tray is used.

According to the first sheet feeder of the invention, as described above, the difference in sheet-mounting-surface level between the sheet mounting surface of the sheet tray body and that of the sheet feeder body at the time of using the sheet tray body is alleviated by providing the step-like part in the sheet tray body in such a way as to be placed in the connection portion, in which the upper edge part of the sheet mounting portion of the sheet feeder body and the sheet tray body are connected to each other, when the sheet tray body is used. This mitigates the inconvenience that a sheet of paper is caught by the step-like part during paper feeding. Moreover, the sheet tray body is easily placed in a position, in which the sheet tray body is enabled so that the difference in sheet-mounting-surface level between the sheet mounting surface of the sheet tray body and that of the sheet feeder body at the time of using the sheet tray body is alleviated, by providing the thrusting member, which is operative to frontwardly push the sheet tray body when the sheet tray body is used, in the sheet tray body. Incidentally, the sheet tray body is disposed in such a way as to be able to turn around the shaft provided in such a manner as to be nearly perpendicular to the sheet mounting surface thereof. Consequently, the sheet tray body is easily drawn out when the sheet tray body is used, and accommodated when the sheet tray body is not used, by laterally turning the sheet tray body.

According to an embodiment (hereunder referred to as a second sheet feeder) of the first sheet feeder of the invention, the thrusting member includes an abutting rib, provided on a rear surface of the sheet tray body in such a manner as to be integral with the sheet tray body, for frontwardly pushing the sheet tray body by abutting against the sheet feeder body as the sheet tray body turns.

According to the second sheet feeder of the invention, as described above, an abutting rib serving as the thrusting member for frontwardly pushing the sheet tray body by abutting against the sheet feeder body with turning the sheet tray body is provided on the rear surface of the sheet tray body in such a manner as to be integral with the sheet tray body. Thus, the second sheet feeder has an advantageous effect in that the number of components and the number of man-hours needed for fabricating the sheet feeder remain unincreased even when the abutting rib serving as the thrusting member is added to the sheet feeder.

According to an embodiment (hereunder referred to as a third sheet feeder) of the first or second sheet feeder of the invention, the upper edge part of the sheet feeder body has a tapered shape.

According to the third sheet feeder of the invention, as described above, the difference in sheet-mounting-surface level between the sheet mounting surface of the sheet tray body and that of the sheet feeder body at the time of using the sheet tray body is alleviated by forming the upper edge part of the sheet mounting portion of the sheet feeder body in such a way as to have a tapered shape. Consequently, the difference in sheet-mounting-surface level between the sheet mounting surface of the sheet tray body and that of the sheet feeder body at the time of using the sheet tray body is more effectively alleviated by utilizing both the step-like part of the sheet tray body of the first sheet feeder of the invention and the tapered upper edge part of the sheet mounting portion of the sheet feeder body. The third sheet feeder more effectively mitigates the inconvenience that a sheet of paper is caught by the step-like part during paper feeding.

To achieve the foregoing object, according to another aspect of the invention, there is provided a sheet tray that comprises a sheet tray body disposed in such a way as to be able to rotate around a shaft, which is provided in such a manner as to be nearly perpendicular to a sheet mounting surface, and enabled to be accommodated in a sheet feeder body, a step-like part provided in the sheet tray body in such a fashion as to be placed in a connection portion, in which the sheet tray body and an upper edge part of a sheet mounting portion of the sheet feeder body are connected to each other, when the sheet tray body is used, and a thrusting member for frontwardly pushing the sheet tray body when the sheet tray body is used.

According to this sheet tray of the invention, as described above, the difference in sheet-mounting-surface level between the sheet mounting surface of the sheet tray body and that of the sheet feeder body at the time of using the sheet tray body is alleviated by providing the step-like part in the sheet tray body in such a way as to be placed in the connection portion, in which the upper edge part of the sheet mounting portion of the sheet feeder body and the sheet tray body are connected to each other, when the sheet tray body is used. This sheet tray mitigates the inconvenience that a sheet of paper is caught by the step-like part during paper feeding. Moreover, the sheet tray body is easily placed in a position, in which the sheet tray body is enabled so that the difference in sheet-mounting-surface level between the sheet mounting surface of the sheet tray body and that of the sheet feeder body at the time of using the sheet tray body is alleviated, by providing the thrusting member, which is operative to frontwardly push the sheet tray body when the sheet tray body is used, in the sheet tray body. Incidentally, the sheet tray body is disposed in such a way as to be able to turn around the shaft provided in such a manner as to be nearly perpendicular to the sheet mounting surface thereof. Consequently, the sheet tray body is easily drawn out when the sheet tray body is used, and accommodated when the sheet tray body is not used, by laterally turning the sheet tray body.

To achieve the foregoing object, according to another aspect of the invention, there is provided a sheet feeder (hereunder referred to as a fourth sheet feeder) that comprises a sheet tray body rotatably provided and enabled to be accommodated in a sheet feeder body, a step-like part provided in the sheet tray body in such a fashion as to be placed in a connection portion, in which the sheet tray body and an upper edge part of a sheet mounting portion of the sheet feeder body are connected to each other, when the sheet tray body is used, and a thrusting member for frontwardly pushing the sheet tray body when the sheet tray body is used.

According to the fourth sheet feeder of the invention, as described above, the difference in sheet-mounting-surface level between the sheet mounting surface of the sheet tray body and that of the sheet feeder body at the time of using the sheet tray body is alleviated by providing the step-like part in the sheet tray body in such a way as to be placed in the connection portion, in which the upper edge part of the sheet mounting portion of the sheet feeder body and the sheet tray body are connected to each other, when the sheet tray body is used. The fourth sheet feeder mitigates the inconvenience that a sheet of paper is caught by the step-like part during paper feeding. Moreover, the sheet tray body is easily placed in a position, in which the sheet tray body is enabled so that the difference in sheet-mounting-surface level between the sheet mounting surface of the sheet tray body and that of the sheet feeder body at the time of using the sheet tray body is alleviated, by providing the thrusting member, which is used for frontwardly pushing the sheet tray body when the sheet tray body is used, in the sheet tray body. Incidentally, the sheet tray body is disposed in such a way as to be able to turn around the shaft provided in such a manner as to be nearly perpendicular to the sheet mounting surface thereof. Consequently, the sheet tray body is easily drawn out when the sheet tray body is used, and accommodated when the sheet tray body is not used, by laterally turning the sheet tray body.

DETAILED DESCRIPTION OF THE PREFERRED EMBODIMENTS

Hereinafter, an embodiment of the invention is described with reference to the accompanying drawings.

First Embodiment

Figure 1:
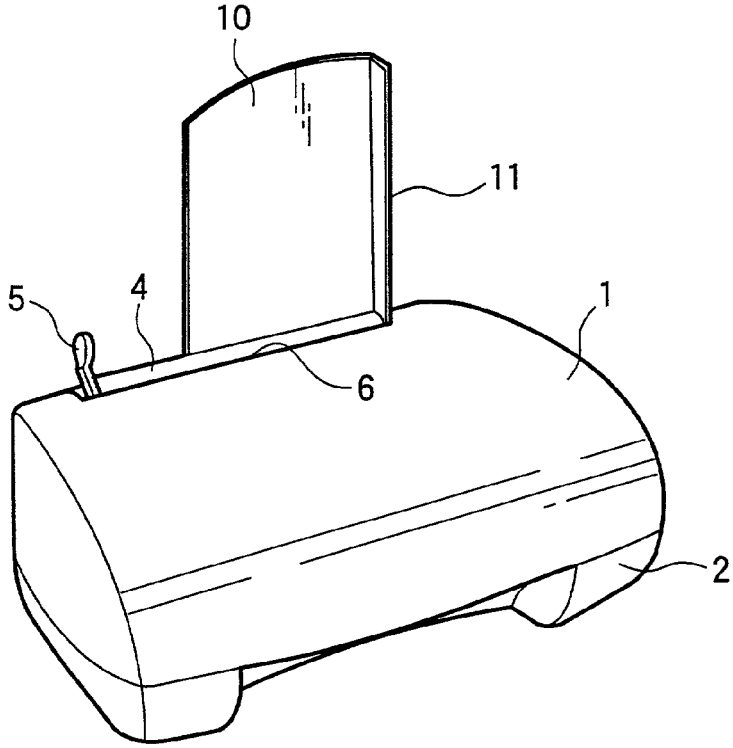
FIG. 1 is a perspective view illustrating a condition (that is, a used condition of a sheet tray), in which a sheet tray is drawn out of an ink jet printer having the sheet tray according to a first embodiment of the invention.
Figure 2:
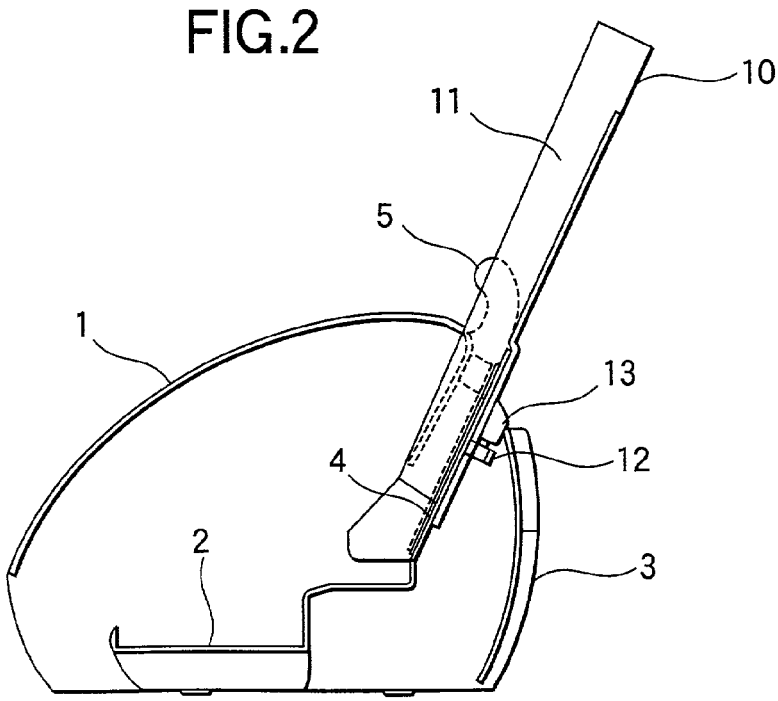
FIG. 2 is a sectional side view illustrating the ink jet printer according to the first embodiment of the invention shown in FIG. 1, and taken from the right side thereof, as viewed in FIG. 1.
Figure 3:
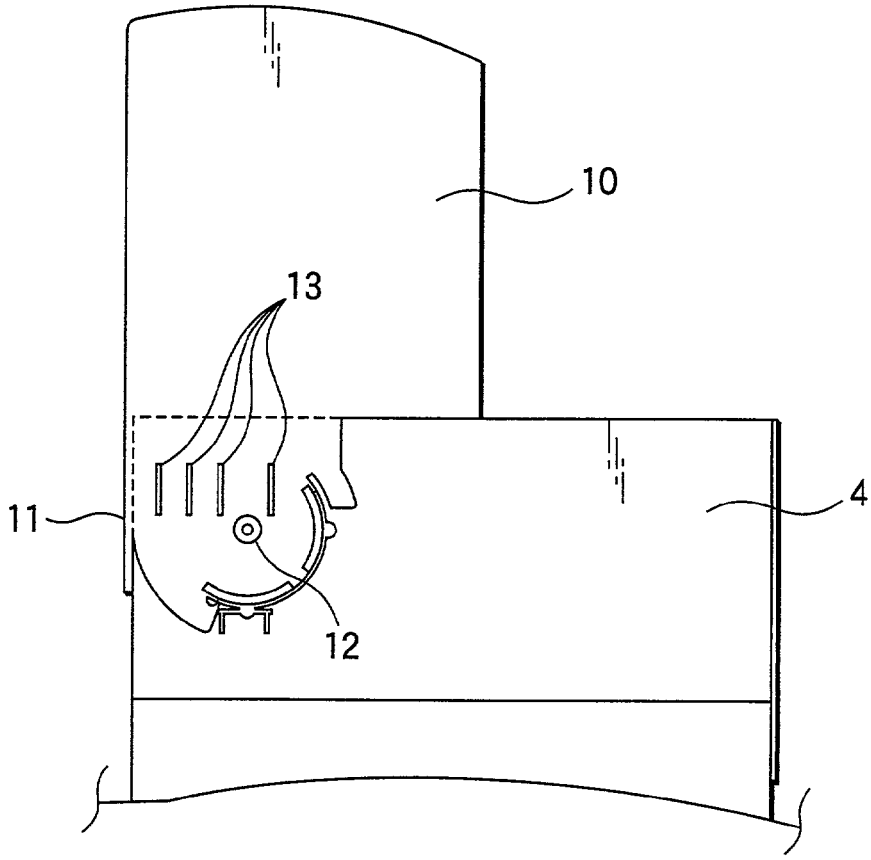
FIG. 3 is a partially sectional view illustrating the ink jet printer according to the first embodiment of the invention shown in FIG. 1, and taken from the rear side thereof, as viewed in FIG. 1.
Figure 4:
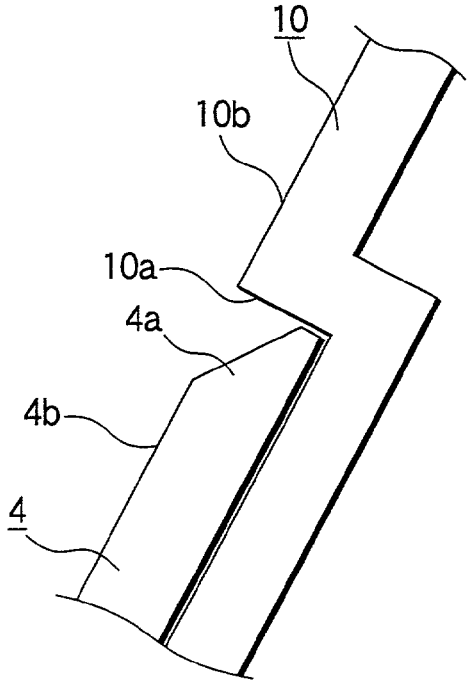
FIG. 4 is an enlarged sectional side view illustrating a connection portion in which a sheet tray and a sheet mounting portion of the first embodiment shown in FIG. 2 are connected to each other.

FIG. 1 is a perspective view illustrating a condition (that is, a used condition), in which a sheet tray is drawn out of an ink jet printer having the sheet tray according to a first embodiment of the invention. FIG. 2 is a sectional side view illustrating the ink jet printer shown in FIG. 1 and taken from the right side thereof, as viewed in FIG. 1. FIG. 3 is a partially sectional view illustrating the ink jet printer shown in FIG. 1, and taken from the rear side thereof, as viewed in FIG. 1. FIG. 4 is an enlarged sectional side view illustrating a connection portion in which a sheet tray and a sheet mounting portion shown in FIG. 2 are connected to each other.

First, an outline of the configuration of an ink jet printer according to a first embodiment of the invention is described hereinbelow by referring to FIGS. 1 to 2. The ink jet printer of the first embodiment has a bottom cover 2, a back cover 3 disposed on the rear surface thereof, and a front cover 1 disposed on the front surface thereof, as shown in FIG. 2. A sheet mounting portion 4 is provided on the bottom cover 2. The bottom cover 2, the back cover 3, and the front cover 1 cover a motor (not shown) for driving a printer engine portion and other constituent elements of the printer. Further, as shown in FIG. 1, a sheet setting opening 6 is provided between the front cover 1 and the sheet mounting portion 4. Furthermore, a sheet guide portion 5 is provided on the sheet mounting portion 4 in such a manner as to be able to move in a transverse direction according to a sheet size.

Next, the details of the configuration of a sheet tray of the sheet feeder according to the first embodiment are described hereinbelow by referring to FIGS. 1 to 4. In the sheet feeder of the first embodiment, a sheet tray 10 is supported on a shaft 12, which is provided in such a way as to extend in a direction perpendicular to a sheet mounting surface, in such a manner as to be able to laterally turn therearound, as illustrated in FIGS. 2 and 3. This shaft 12 is provided on the rear surface of the sheet mounting portion 4 in such a way as to be integral therewith. Moreover, a sheet guide portion 11 is provided on the sheet tray 10, as illustrated in FIG. 1. The sheet guide portion 11 is formed in such a way as to be integral with the sheet tray 10.

Incidentally, in the first embodiment, a step-like part 10*a* is provided in the sheet tray 10, as illustrated in FIG. 4. This step-like part 10a is provided in such a way as to be placed in a connection portion, in which the upper edge part 4*a* of the sheet mounting portion 4 and the sheet tray 10 are connected to each other, when the sheet tray 10 is used. Further, as shown in FIG. 4, the upper edge part 4*a* of the sheet mounting portion 4 of the sheet feeder is formed in such a manner as to have a tapered shape. Furthermore, as illustrated in FIGS. 2 and 3, an abutting rib 13 for frontwardly pushing the sheet tray 10 at the time of using the sheet tray 10 is provided on the rear surface of the sheet tray 10. This abutting rib 13 is formed in such a way as to be integral with the sheet tray 10. Incidentally, the abutting rib 13 corresponds to the "thrusting member" of the invention.

Figure 5:
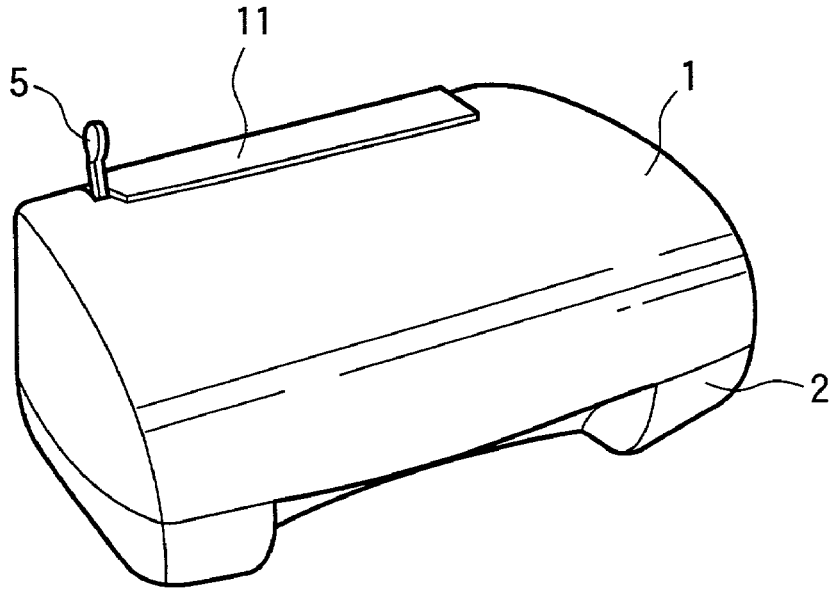
FIG. 5 is a perspective view illustrating a condition in which the sheet tray is accommodated in the ink jet printer having the sheet tray according to the first embodiment shown in FIG. 1.
Figure 6:
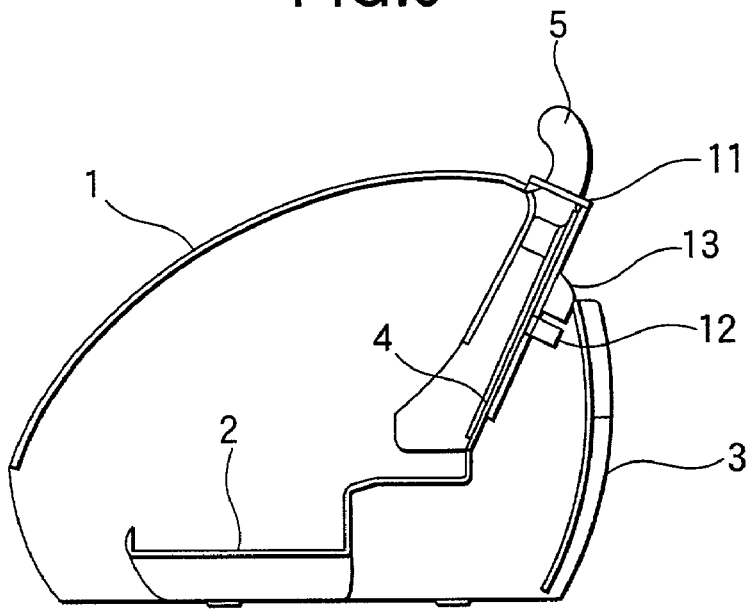
FIG. 6 is a sectional side view illustrating the ink jet printer according to the first embodiment of the invention shown in FIG. 5, and taken from the right side thereof, as viewed in FIG. 5.
Figure 7:
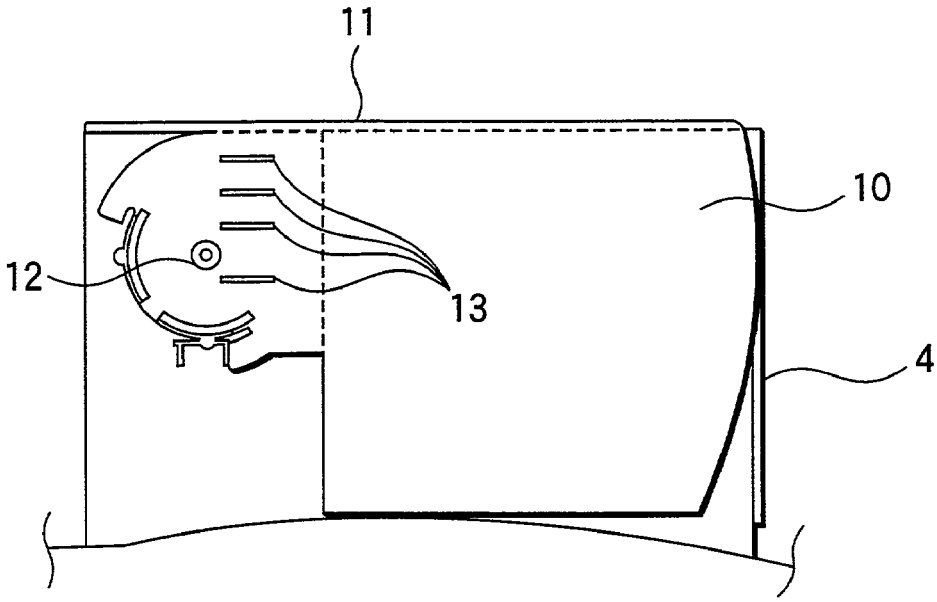
FIG. 7 is a sectional side view illustrating the ink jet printer according to the first embodiment of the invention shown in FIG. 5, and taken from the rear side thereof, as viewed in FIG. 5.

FIG. 5 is a perspective view illustrating a condition in which the sheet tray is accommodated in the ink jet printer having the sheet tray according to the first embodiment. FIG. 6 is a sectional side view illustrating the ink jet printer shown in FIG. 5, and taken from the right side thereof, as viewed in FIG. 5. FIG. 7 is a sectional side view illustrating the ink jet printer shown in FIG. 5, and taken from the rear side thereof, as viewed in FIG. 5.

Next, an operation of changing the condition of the sheet tray of the first embodiment of the invention from the accommodated condition to the used condition by referring to FIGS. 1 to 7.

First, in the accommodated condition, the sheet tray 10 is accommodated in a space provided between the rear surface of the sheet mounting portion 4 of the sheet feeder and the back cover 3, as shown in FIG. 6. When the sheet tray 10 is used, first, the sheet tray 10 is drawn out therefrom. At that time, the sheet tray 10 is drawn out therefrom by laterally turning the sheet tray 10 around the shaft 12. Further, as shown in FIG. 2, when the sheet tray 10 is drawn out therefrom, the abutting rib 13 provided on the rear surface of the sheet tray 10 is caused to abut against an upper portion of the inner surface of the back cover 3. Thus, the sheet tray 10 is frontwardly pushed out. Consequently, as shown in FIG. 4, the step-like part 10*a* provided in the sheet tray 10 is pushed out onto the top surface of the upper edge 4*a* of the sheet mounting portion 4.

In the first embodiment, as described above, the step-like part 10*a* is provided in the sheet tray 10 in such a manner as to be placed in a connection portion, in which the sheet tray 10 and the upper edge portion 4 of the sheet mounting portion 4 of the sheet feeder body are connected to each other, when the sheet tray 10 is used. This alleviates the difference in sheet-mounting-surface level between the sheet mounting surface 10*b* of the sheet tray 10 and that 4*b* of the sheet mounting portion 4 of the sheet feeder, which is caused in the connection portion wherein the sheet tray 10 and the sheet mounting portion 4 are connected to each other. Consequently, this mitigates the inconvenience that a sheet of paper is caught by a step-like part, which is provided in the sheet tray, when the sheet of paper is put on the sheet mounting surface 10*b* of the sheet tray 10 and the sheet mounting surface 4*b* of the sheet mounting portion 4.

Furthermore, in the first embodiment, as described above, the upper edge part 4*a* of the sheet mounting surface 4*b* of the sheet feeder body is formed in such a way as to have a tapered shape. Thus, as illustrated in FIG. 4, the difference in sheet-mounting-surface level between the sheet mounting surface 10*b* of the sheet tray 10 and the upper edge part 4*a* of the sheet mounting surface 4*b* of the sheet mounting portion 4, which is caused in the connection portion wherein the sheet tray 10 and the sheet mounting portion 4 are connected to each other, is alleviated. Consequently, this embodiment mitigates the inconvenience that a sheet of paper is caught by a step-like part, which is provided in the sheet tray, when the sheet of paper is put on the sheet mounting surface 10*b* of the sheet tray 10 and the sheet mounting surface 4*b* of the sheet mounting portion 4. That is, the first embodiment utilizes both the step-like part 10*a* of the sheet tray 10 and the tapered upper edge part 4*a* of the sheet mounting portion 4 to thereby effectively prevent a sheet of paper from being caught by the step-like part in the connection portion in which the sheet tray 10 and the sheet mounting portion 4 are connected to each other.

Furthermore, the first embodiment has the abutting rib 13 that is provided on the rear surface of the sheet tray 10 and that is operative to frontwardly push the sheet tray 10 by abutting against the back cover 3. Thus, when the sheet tray 10 is used, the step-like part 10*a* of the sheet tray 10 is easily pushed out onto the top surface of the upper edge part 4*a* of the sheet mounting portion 4. Consequently, the sheet tray 10 is easily placed in a suitable position in such a way as to alleviate the difference in sheet-mounting-surface level between the sheet mounting surface 10*b* of the sheet tray 10 and the sheet mounting surface 4*b* of the sheet mounting portion 4, which is caused in the connection portion wherein the sheet tray 10 and the sheet mounting portion 4 are connected to each other. Moreover, the abutting rib 13 is provided in such a manner as to be integral with the sheet tray 10. Consequently, the first embodiment has an advantageous effect in that the number of components and the number of man-hours needed for fabricating the sheet feeder remain unincreased even when the abutting rib 13 is added to the sheet feeder.

Further, in the first embodiment, the sheet tray 10 is disposed in such a way as to be able to turn around the shaft 12 provided in such a manner as to be nearly perpendicular to the sheet mounting surface thereof. Moreover, the sheet tray 10 is provided in such a way as to be able to be accommodated in the space between the sheet mounting portion 4 provided in the sheet feeder body and the back cover 3. Consequently, the sheet tray 10 is easily drawn out when the sheet tray body is used, and accommodated when the sheet tray body is not used, by laterally turning the sheet tray 10.

Second Embodiment

Figure 8:
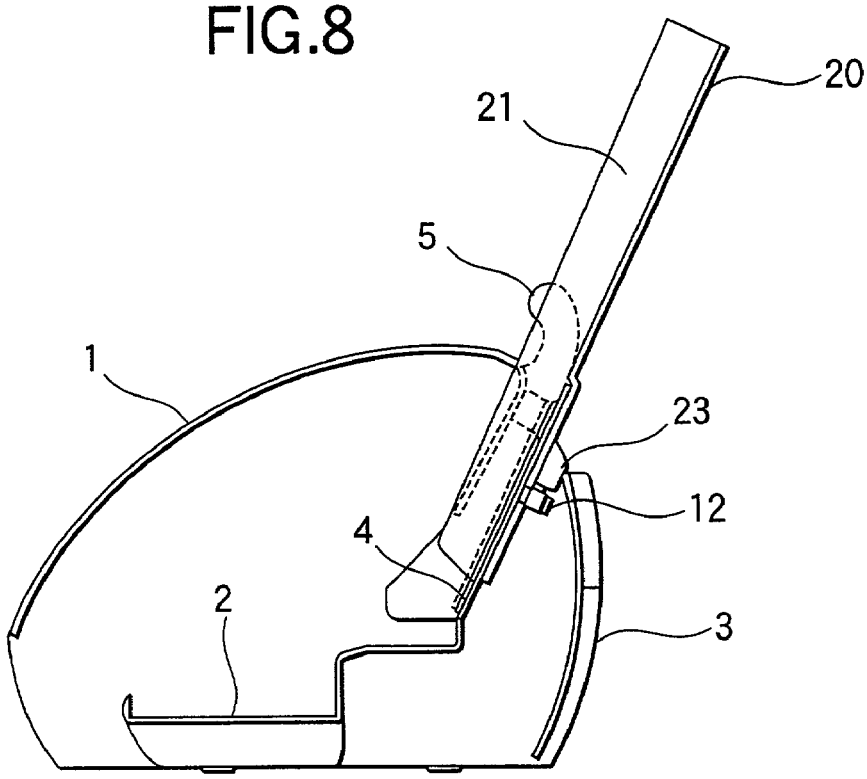
FIG. 8 is a sectional side view illustrating a condition (that is, a used condition of a sheet tray), in which a sheet tray is drawn out of an ink jet printer having the sheet tray according to a second embodiment of the invention, and taken from the right side thereof, as viewed in this figure.
Figure 9:
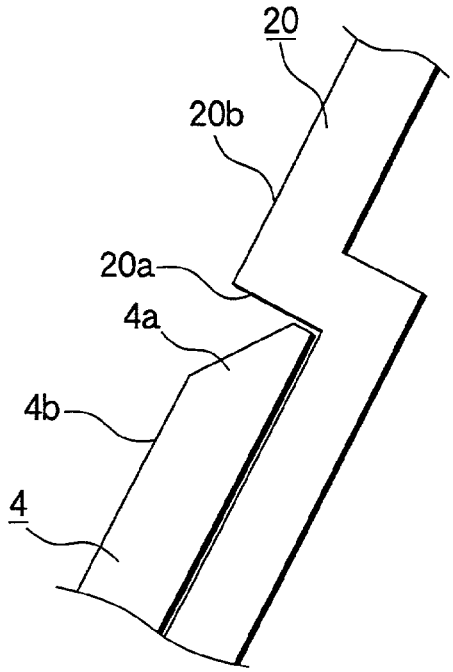
FIG. 9 is an enlarged sectional side view illustrating a connection portion, in which a sheet tray and a sheet mounting portion of the second embodiment shown in FIG. 8 are connected to each other.
Figure 10:
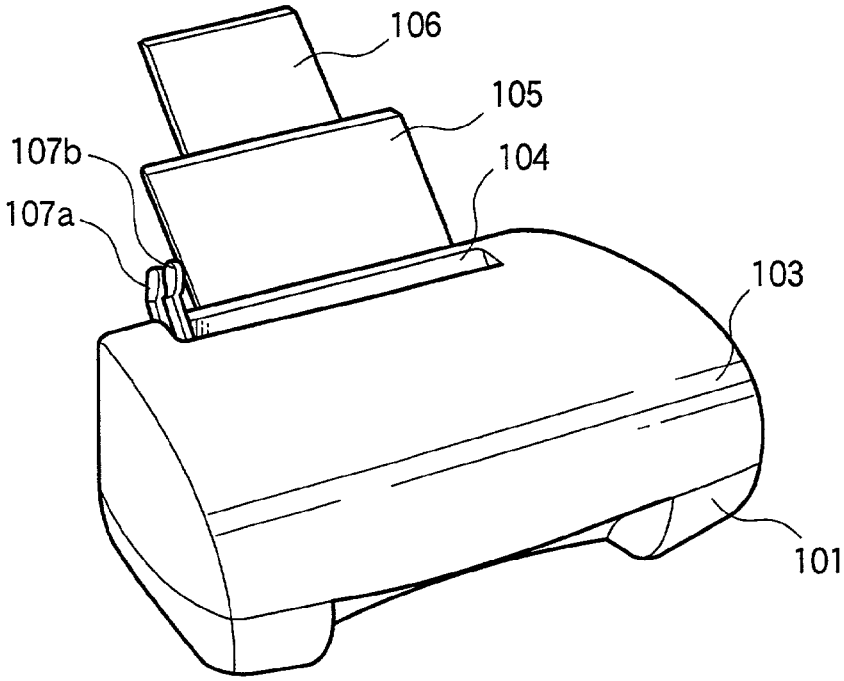
FIG. 10 is a perspective view illustrating a conventional ink jet printer having drawer type sheet trays.
Figure 11:
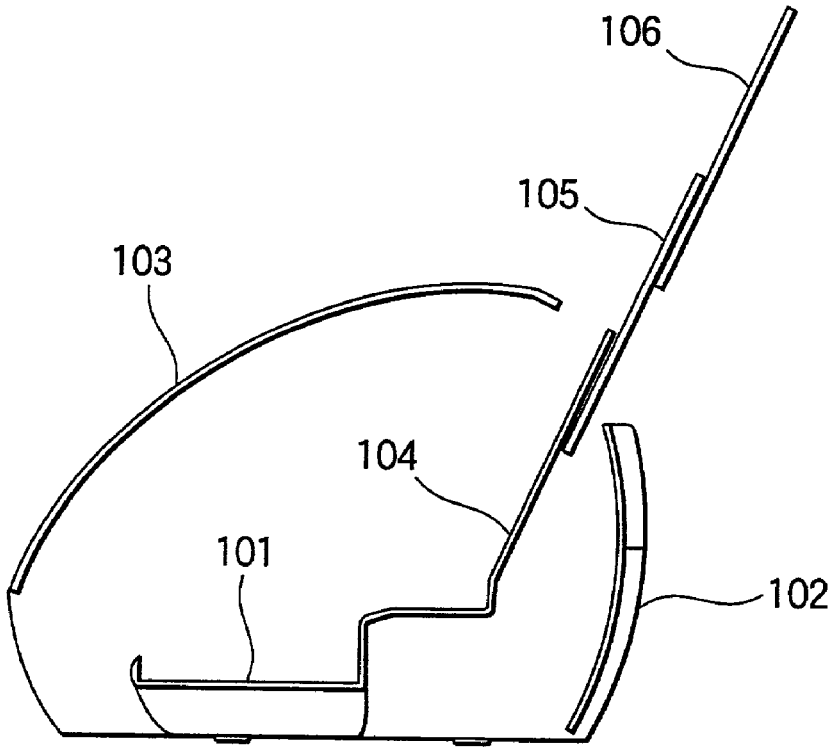
FIG. 11 is a sectional side view, taken from the right side of FIG. 10, and illustrating a condition (that is, a used condition of the sheet tray), in which the sheet trays are drawn out of the conventional ink jet printer.
Figure 12:
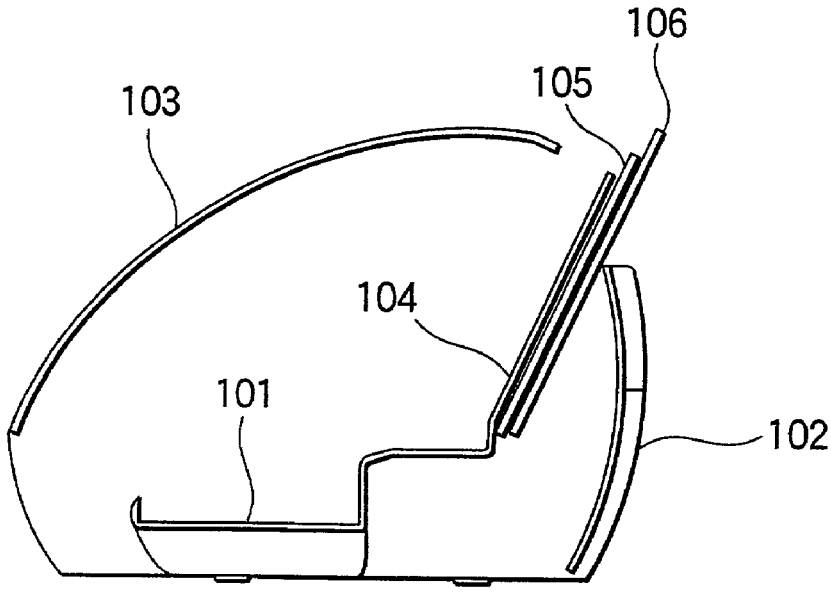
FIG. 12 is a sectional side view illustrating an accommodated condition (that is, an unused condition of the sheet tray), in which the sheet trays are accommodated in the conventional ink jet printer shown in FIG. 10.

FIG. 8 is a sectional side view illustrating a condition (that is, a used condition), in which a sheet tray is drawn out of an ink jet printer having the sheet tray according to a second embodiment of the invention. FIG. 9 is an enlarged sectional side view illustrating a connection portion, in which a sheet tray and a sheet mounting portion shown in FIG. 8 are connected to each other.

The details of the configuration of a sheet tray 20 according to a second embodiment of the invention are described hereinbelow with reference to FIGS. 8 and 9. As shown in FIG. 8, the sheet tray 20 of the second embodiment is supported on the shaft 12, which is provided in such a way as to extend in a direction perpendicular to the sheet mounting surface, in such a manner as to be able to laterally turn, similarly as the sheet tray of the first embodiment. Further, the sheet tray 20 is disposed in such a manner as to be able to be accommodated in the space that is provided between the rear surface of the sheet mounting portion 4 provided in the sheet feeder body and the back cover 3. Further, a sheet guide portion 21 is provided in the sheet tray 20, similarly as the first embodiment. The sheet guide portion 21 is formed in such a way as to be integral with the sheet tray 20. Moreover, as illustrated in FIG. 9, the sheet tray 20 consists of the step-like part 20*a* and the sheet mounting surface 20*b*. This step-like part 20*a* is provided in such a manner as to be placed in the connection portion, in which the sheet tray 20 and the upper edge part 4*a* of the sheet mounting portion 4 are connected to each other, similarly as the step-like part of the first embodiment.

Further, as shown in FIG. 8, the abutting rib 23 is provided on the rear surface of the sheet tray 20. The abutting rib 23 is formed in such a manner as to be integral with the sheet tray 20, similarly as the abutting rib of the first embodiment. Furthermore, as illustrated in FIG. 9, the upper edge part 4*a* of the sheet mounting portion 4 is formed in such a way as to have a tapered shape, similarly as the upper edge part of the first embodiment.

Incidentally, in the second embodiment, the step-like part 20*a* provided in the sheet tray 20 is formed so that the sheet mounting surface 4*b* of the sheet mounting portion 4 is almost flush with the sheet mounting surface 20*b* of the sheet tray 20 when the sheet tray 20 is used, as shown in FIG. 9, differently from the first embodiment.

In the second embodiment, as described above, the step-like part 20*a* is formed so that the sheet mounting surface 4*b* of the sheet mounting portion 4 is nearly flush with the sheet mounting surface 20*b* of the sheet tray 20 when the sheet tray 20 is used. Thus, the second embodiment is put into a state, in which there is substantially no difference in sheet-mounting-surface level between the sheet mounting surface 20*b* of the sheet tray 20 and the sheet mounting surface 4*b* of the sheet mounting portion 4 when the sheet tray 20 is used, differently from the first embodiment. Consequently, the second embodiment more effectively mitigates the inconvenience that a sheet of paper is caught by the step-like part when the sheet of paper is put on the sheet mounting surface 20*b* of the sheet tray 20 and the sheet mounting surface 4*b* of the sheet mounting portion 4, as compared with the first embodiment.

Further, in the second embodiment, the upper edge part 4*a* of the sheet mounting portion 4 is formed in such a way as to have a tapered shape, similarly as the upper edge part in the first embodiment. Thus, the second embodiment alleviates the difference in sheet-mounting-surface level between the sheet-mounting-surface of the sheet tray 20 and that of the upper edge part 4*a* of the sheet tray 20 in the connection portion in which the sheet tray 20 and the upper edge part 4*a* are connected to each other. Consequently, the second embodiment mitigates the inconvenience that a sheet of paper is caught by the step-like part during paper feeding.

Furthermore, similarly as the first embodiment, the second embodiment has an abutting rib 23 that is provided on the rear surface of the sheet tray 20 and that is operative to frontwardly push the sheet tray 20 by abutting against an upper part of the inner surface of the back cover 3. Thus, when the sheet tray 20 is used, the step-like part 20*a* of the sheet tray 20 is easily pushed out onto the top surface of the upper edge part 4*a* of the sheet mounting portion 4. Consequently, the sheet tray 20 is easily placed in a suitable position in such a way as to alleviate the difference in sheet-mounting-surface level between the sheet mounting surface 20*b* of the sheet tray 20 and the sheet mounting surface 4*b* of the sheet mounting portion 4, which is caused in the connection portion wherein the sheet tray 20 and the sheet mounting portion 4 are connected to each other. Moreover, the abutting rib 23 is provided in such a manner as to be integral with the sheet tray 20. Consequently, the second embodiment has an advantageous effect in that the number of components and the number of man-hours needed for fabricating the sheet feeder remain unincreased even when the abutting rib 23 is added to the sheet feeder.

Further, in the first embodiment, the sheet tray 20 is disposed in such a way as to be able to turn around the shaft 12 provided in such a manner as to be nearly perpendicular to the sheet mounting surface thereof, similarly as the sheet tray in the first embodiment. Moreover, the sheet tray 20 is provided in such a way as to be able to be accommodated in the space between the sheet mounting portion 4 provided in the sheet feeder body and the back cover 3. Consequently, the sheet tray 20 is easily drawn out when the sheet tray body is used, and accommodated when the sheet tray body is not used, by laterally turning the sheet tray 10.

Incidentally, it should be considered that the embodiments disclosed herein are illustrative in every respect, and that the invention is not limited thereto. The scope of the invention is determined by the appended claims, instead of the foregoing description of the embodiments. Further, all modifications and equivalents, which may occur to those skilled in the art, are considered to be within the scope of the invention.

For example, although the step-like part 20*a* to be provided in the sheet tray 20 is formed in the second embodiment so that the sheet mounting surface 4*b* of the sheet mounting portion 4 is nearly flush with the sheet mounting surface 20*b* of the sheet tray 20, the sheet tray of the invention is not limited thereto. Even when the step-like part 20*b* is formed so that the sheet mounting surface 20*b* of the sheet tray 20 is higher than the sheet mounting surface 4*b* of the sheet mounting portion 4, similar effects are obtained.

As described above, the invention can provide a sheet feeder and a sheet tray, which are enabled to mitigate a difference in sheet-mounting-surface level between a sheet mounting surface of a sheet tray body and that of a sheet mounting portion of a feeder body in a connection portion in which the sheet tray body and the sheet mounting portion are connected to each other.

What is claimed is:

1. A sheet feeder comprising:

a sheet tray body disposed in such a way as to rotate around a shaft, which is provided in such a manner as to be nearly perpendicular to a sheet mounting surface, and enabled to be accommodated in a sheet feeder body;

a stepped portion provided in said sheet tray body in such a fashion as to be placed in a connection portion, in which said sheet tray body and an upper edge part of a sheet mounting portion of said sheet feeder body are connected to each other, when said sheet tray body is used; and a thrusting member provided on a rear surface of said sheet tray body for frontwardly pushing said sheet tray body when said sheet tray is used thereby allowing said sheet tray to be retained in an open position, wherein the thrusting member abuts a back cover of said sheet feeder, when said sheet tray body is used and pushes the sheet tray body towards the sheet mounting surface, wherein said back cover is part of a main body of said sheet feeder and is configured to cover at least one internal component of said sheet feeder.

2. The sheet feeder according to claim 1, wherein said thrusting member includes an abutting rib, provided on a rear surface of said sheet tray body in such a manner as to be integral with said sheet tray body, for frontwardly pushing said sheet tray body by abutting against said sheet feeder body as said sheet tray body turns.

3. The sheet feeder according to claim 1, wherein said upper edge part of said sheet feeder body has a tapered shape.

4. The sheet feeder according to claim 3, wherein said sheet mounting portion at the upper edge part is less in thickness than the depth of the stepped portion.

5. The sheet feeder according to claim 1, wherein said stepped portion is formed on the sheet tray body at the side where the sheet mounting portion is disposed, thereby eliminating the difference in level between the sheet mounting portion and the sheet mounting surface.

6. A sheet tray comprising:

a sheet tray body disposed in such a way as to be able to rotate around a shaft, which is provided in such a manner as to be nearly perpendicular to a sheet mounting surface, and enabled to be accommodated in a sheet feeder body;

a stepped portion provided in said sheet tray body in such a fashion as to be placed in a connection portion, in which said sheet tray body and an upper edge part of a sheet mounting portion of said sheet feeder body are connected to each other, when said sheet tray body is used; and a thrusting member provided on a rear surface of said sheet tray body for frontwardly pushing said sheet tray body when said sheet tray body is used thereby allowing said sheet tray to be retained in an open position, wherein the thrusting member abuts a back cover of a sheet feeder of said sheet tray, when said sheet tray body is used and pushes the sheet tray body towards the sheet mounting surface, wherein said back cover is part of a main body of said sheet feeder and is configured to cover at least one internal component of said sheet feeder.

7. The sheet tray according to claim 6, wherein said stepped portion is formed on the sheet tray body at the side where the sheet mounting portion is disposed, thereby eliminating the difference in level between the sheet mounting portion and the sheet mounting surface.

8. A sheet feeder comprising:

a sheet tray body rotatably provided and enabled to be accommodated in a sheet feeder body;

a stepped portion provided in said sheet tray body in such a fashion as to be placed in a connection portion, in which said sheet tray body and an upper edge part of a sheet mounting portion of said sheet feeder body are connected to each other, when said sheet tray body is used; and a thrusting member provided on a rear surface of said sheet tray body for frontwardly pushing said sheet tray body when said sheet tray body is used thereby allowing said sheet tray to be retained in an open position, wherein the thrusting member abuts a back cover of said sheet feeder, when said sheet tray body is used and pushes the sheet tray body towards the sheet mounting surface, wherein said back cover is part of a main body of said sheet feeder and is configured to cover at least one internal component of said sheet feeder.

9. The sheet feeder according to claim 8, wherein said stepped portion is formed on the sheet tray body at the side where the sheet mounting portion is disposed, thereby eliminating the difference in level between the sheet mounting portion and a sheet mounting surface.

10. A sheet feeder comprising:

a sheet tray body disposed in such a way as to rotate around a shaft, which is provided in such a manner as to be nearly perpendicular to a sheet mounting surface, and enabled to be accommodated in a sheet feeder body;

a stepped portion provided in said sheet tray body in such a fashion as to be placed in a connection portion, in which said sheet tray body and an upper edge part of a sheet mounting portion of said sheet feeder body are connected to each other, when said sheet tray body is used, wherein said stepped portion is formed on the sheet tray body at the side where the sheet mounting portion is disposed, thereby eliminating a difference in level between the sheet mounting portion and the sheet mounting surface; and a thrusting member provided on a rear surface of said sheet tray body for frontwardly pushing said sheet tray body when said sheet tray is used thereby allowing said sheet tray to be retained in an open position, wherein the thrusting member abuts a back cover of said sheet feeder, when said sheet tray body is used and pushes the sheet tray body towards the sheet mounting surface wherein said stepped portion is formed on the sheet tray body at the side where the sheet mounting portion is disposed, thereby eliminating a difference in level between the sheet mounting portion and the sheet mounting surface, wherein said back cover is part of a main body of said sheet feeder and is configured to cover at least one internal component of said sheet feeder.

* * * * *